US011821629B2

(12) United States Patent
Gralki et al.

(10) Patent No.: US 11,821,629 B2
(45) Date of Patent: Nov. 21, 2023

(54) COMBUSTION CHAMBER

(71) Applicant: Siemens Energy Global GmbH & Co. KG, Bayern (DE)

(72) Inventors: Matthias Gralki, Mulheim an der Ruhr (DE); Claus Krusch, Essen (DE); Daniel Schmidt, Mülheim an der Ruhr (DE)

(73) Assignee: Siemens Energy Global GmbH & Co. KG, Bayern (DE)

( * ) Notice: Subject to any disclaimer, the term of this patent is extended or adjusted under 35 U.S.C. 154(b) by 7 days.

(21) Appl. No.: 17/420,674

(22) PCT Filed: Dec. 16, 2019

(86) PCT No.: PCT/EP2019/085232
§ 371 (c)(1),
(2) Date: Jul. 4, 2021

(87) PCT Pub. No.: WO2020/148045
PCT Pub. Date: Jul. 23, 2020

(65) Prior Publication Data

US 2022/0099296 A1 Mar. 31, 2022

(30) Foreign Application Priority Data

Jan. 17, 2019 (DE) ..... 10 2019 200 593.4

(51) Int. Cl.
*F23R 3/00* (2006.01)
*F23R 3/60* (2006.01)

(52) U.S. Cl.
CPC ..... *F23R 3/002* (2013.01); *F23R 3/60* (2013.01); *F23R 2900/00005* (2013.01); *F23R 2900/00017* (2013.01)

(58) Field of Classification Search
CPC .. F23R 3/002; F23R 3/60; F23R 2900/00005; F23R 2900/00017
See application file for complete search history.

(56) References Cited

U.S. PATENT DOCUMENTS 4,749,298 A 6/1988 Bundt et al.
5,104,287 A * 4/1992 Ciokajlo ..... F04D 29/164 415/173.2

(Continued)

FOREIGN PATENT DOCUMENTS

CN 88102602 A 11/1988
CN 2837127 Y 11/2006

(Continued)

OTHER PUBLICATIONS

PCT International Search Report and Written Opinion of International Searching Authority dated May 4, 2020 corresponding to PCT International Application No. PCT/EP2019/085232 filed Dec. 16, 2019.

(Continued)

*Primary Examiner* — Arun Goyal
*Assistant Examiner* — Henry Ng
(74) *Attorney, Agent, or Firm* — Wolter Van Dyke Davis, PLLC

(57) ABSTRACT

A combustion chamber, in particular for a gas turbine, includes a support structure, a plurality of retaining elements fastened to the support structure, and a plurality of heat shield elements which jointly form a heat shield and which each have a hot gas side, a cold gas side and end faces which interconnect the hot gas side and the cold gas side, the retaining elements interlockingly engaging in recesses in the heat shield elements. The retaining elements each have at least two engagement portions for interlockingly engaging in the recesses in a heat shield element, which engagement portions are interconnected in a tensionally rigid manner and (Continued)

are tensionally rigid themselves. Spring elements extend between the support structure and the heat shield elements, which spring elements are designed in particular as leaf springs and effect a frictional connection between the engagement portions of the retaining elements and the heat shield elements.

19 Claims, 7 Drawing Sheets

(56) References Cited

U.S. PATENT DOCUMENTS

| | | | | |
|---|---|---|---|---|
| 2003/0056515 | A1 | 3/2003 | Bast et al. | |
| 2005/0150233 | A1 | 7/2005 | Glessner et al. | |
| 2005/0242525 | A1* | 11/2005 | Dahlke | F23R 3/002 277/605 |
| 2009/0056307 | A1 | 3/2009 | Mons | |
| 2009/0056339 | A1 | 3/2009 | Fischer et al. | |
| 2011/0088875 | A1 | 4/2011 | Hou | |
| 2011/0318531 | A1* | 12/2011 | Krusch | F23M 5/04 428/131 |
| 2015/0247640 | A1 | 9/2015 | Vogtmann | |
| 2015/0345790 | A1* | 12/2015 | Ruberte Sanchez | F02K 1/82 60/753 |
| 2015/0354820 | A1 | 12/2015 | Vetters | |
| 2016/0131362 | A1* | 5/2016 | Vogtmann | F23R 3/007 60/752 |
| 2016/0201910 | A1 | 7/2016 | Chang et al. | |
| 2016/0252248 | A1* | 9/2016 | Ruberte Sanchez | F23R 3/002 60/753 |
| 2018/0202659 | A1* | 7/2018 | Stieg | F23R 3/002 |
| 2018/0283694 | A1* | 10/2018 | Greenfield | F23R 3/283 |
| 2018/0299133 | A1* | 10/2018 | Kramer | F23R 3/06 |
| 2019/0107286 | A1* | 4/2019 | Buse | F23M 5/04 |
| 2020/0355369 | A1* | 11/2020 | Hu | F23R 3/60 |

FOREIGN PATENT DOCUMENTS

| | | | |
|---|---|---|---|
| CN | 102042776 | A | 5/2011 |
| CN | 103518100 | A | 1/2014 |
| CN | 103630722 | A | 7/2014 |
| CN | 203979237 | U | 12/2014 |
| CN | 104769362 | A | 7/2015 |
| CN | 214064984 | U | 8/2021 |
| DE | 602005000935 | T2 | 1/2008 |
| DE | 102013219187 | B3 | 2/2015 |
| DE | 102016214818 | A1 | 4/2017 |
| DE | 102017206502 | A1 | 10/2018 |
| EP | 1288601 | A1 | 3/2003 |
| EP | 1591724 | A1 | 11/2005 |
| EP | 1591724 | B1 | 6/2011 |
| WO | 2015043953 | A1 | 4/2015 |
| WO | 2016050535 | A1 | 4/2016 |
| WO | 2018068980 | A1 | 4/2018 |

OTHER PUBLICATIONS

Zhang, Xing et al: "Application of the wall temperature thermocouple in the temperature measurement of the engine heat shield"; Aeroengine; Issue 03, pp. 37-39 & 8, Year: 1996.

Liu, Huiming: "Practice and research of gas turbines and their technology for combined cycle power generation"; pp. 34-37, Year: 5. Jun. 2018.

English-language machine translation of the search report from corresponding Chinese Patent Application No. 201980089756.9 dated April 7, 2022 referencing the Non-Patent Literature as defining the general state of the art.

* cited by examiner

COMBUSTION CHAMBER

CROSS REFERENCE TO RELATED APPLICATIONS

This application is the US National Stage of International Application No. PCT/EP2019/085232 filed 16 Dec. 2019, and claims the benefit thereof. The International Application claims the benefit of German Application No. DE 10 2019 200 593.4 filed 17 Jan. 2019. All of the applications are incorporated by reference herein in their entirety.

FIELD OF INVENTION

The invention relates to a combustion chamber, in particular a combustion chamber of a gas turbine, having a support structure, a multiplicity of holding elements which are fastened to the support structure, and a multiplicity of heat shield elements which conjointly form a heat shield, have in each case a hot-gas side, a cold-gas side, and end sides that connect the hot-gas side and the cold-gas side to one another, wherein the holding elements engage in a form-fitting manner in recesses which are provided on the heat shield elements. The invention furthermore relates to an assembly and to a heat shield element for implementing such a combustion chamber.

BACKGROUND OF INVENTION

The combustion chambers of gas turbines, for example, by virtue of the high temperatures prevalent during the operation are provided with a heat shield which protects the housing wall of the combustion chamber from the hot atmosphere in the combustion space of the combustion chamber. Heat shields which can resist hot gases with temperatures of, for example, approximately 1000° C. to approximately 1600° C. are known from DE 10 2017 206 502 A1, for example. Heat shields of this type are assembled from many individual planar heat shield elements. Depending on whether metallic or ceramic heat shield elements are used, reference is made to a metallic heat shield (MHS) or a ceramic heat shield (CHS). The heat shield elements, while leaving gaps between the end sides of adjacent heat shield elements, are positioned so as to lie next to one another. These gaps ensure that the heat shield elements during the operation of the combustion chamber can thermally expand in the circumferential direction of the heat shield. However, only a minor gap is left between the support structure and the heat shield elements. Holding elements, which are referred to as brick retainers, and made from metal are used for fixing a heat shield element to the support structure of the combustion chamber. Said holding elements comprise a C-shaped basic shape having two C-legs, specifically one long fastening leg configured for fastening to the support structure and a short engagement leg which is configured for engaging in a holding recess of the heat shield element at the end side, both legs being connected to one another by way of a web. The fastening leg bears on the support structure and is screwed to the latter at the end side.

The primary objective in refining modern stationary gas turbines lies in increasing the conversion efficiency, the latter being a function of the hot gas temperature, on the one hand, and the volumetric flow of cooling air required for cooling the metallic gas turbine components, on the other hand. The higher the hot gas temperature, the more efficient the operation of the gas turbine. However, the higher the volumetric flow of cooling air for protecting the metallic components, the lower the efficiency.

The previously mentioned holding elements require in particular sufficient cooling in order for the function of said holding elements to be able to be permanently guaranteed at the prevailing high temperatures. The volumetric flow of cooling air required for this cooling, which is directed between the support structure and the heat shield elements and as sealing air exits to the combustion chamber through the gaps which are present between the heat shield elements, has to be tapped from the primary volumetric flow of cooling air provided by the compressor and is correspondingly not available for the combustion process and thus not for generating the output of the gas turbine. The size of the gaps here has a strong influence on the volumetric flow of cooling air required. The smaller the gaps, the smaller the volumetric flow of cooling air required for achieving the sealing effect.

SUMMARY OF INVENTION

Proceeding from this prior art, it is an object of the present invention to further optimize a combustion chamber of the type mentioned at the outset in terms of the efficiency of said combustion chamber.

In order for this object to be achieved, the present invention achieves a combustion chamber of the type mentioned at the outset which is characterized in that the holding elements have in each case at least two engagement portions configured for engaging in a form-fitting manner in the recesses of a heat shield element, said engagement portions being connected to one another so as to provide tensile rigidity in such a manner that a diverging movement of the engagement portions is effectively counteracted at temperatures prevalent during the operation of the combustion chamber, and in that spring elements, configured in particular as leaf springs, which cause a force-fit between the engagement portions of the holding elements and the heat shield elements extend between the support structure and the heat shield elements, wherein the engagement portions per se are configured so as to provide tensile rigidity in such a manner that said engagement portions under the effect of the spring forces are dimensionally stable at the temperatures prevalent during the operation of the combustion chamber. A substantial advantage which is associated with a combustion chamber constructed according to the invention, lies in that the gap size between adjacent heat shield elements can in particular be significantly reduced. This is because sufficient space between the support structure and the heat shield elements can be left in such a manner that the heat shield elements during the operation of the combustion chamber can freely expand in the radial direction, as a result of which the expansion of said heat shield elements in the circumferential direction is reduced, on the one hand. On the other hand, additional movements of the heat shield elements caused by a deformation of the holding elements is effectively counteracted thanks to the holding elements according to the invention being configured so as to provide tensile rigidity. As a result, the maximum temperature at which the combustion chamber can be operated can be increased to, for example, 1600° C., which consequently results in an improved output. At the same time, thanks to the narrower gaps between the heat shield elements, the volumetric flow of cooling air can be reduced by up to an estimated 50%, this likewise contributing to an improved output. Moreover, the maintenance intervals can also be increased thanks to the improved thermal shielding of the holding elements.

The recesses are advantageously configured on the cold sides of the heat shield elements. In comparison to recesses disposed on the end side, this has the advantage that the engagement portions of the holding elements which engage in the recesses are better thermally shielded and can also be better cooled by the cooling air.

According to one design embodiment of the present invention, the support structure is provided with circumferentially extending receptacle grooves for receiving the holding elements, as a result of which the assembling and fastening of the holding elements are improved.

Holding elements which are disposed so as to be circumferentially adjacent to one another are advantageously releasably connected to one another by way of connecting elements. Connecting elements of this type serve for equalizing tolerances in the circumferential direction. The connecting elements are in particular screwed to the support structure so as to position the holding elements and thus the heat shield elements in the circumferential direction of the combustion chamber.

The receptacle grooves advantageously have a cross section provided with undercuts, wherein the holding elements and/or the connecting elements are received in a form-fitting manner in the receptacle grooves. In this way, the holding elements and thus the heat shield elements are secured in the radial direction as well as the axial direction of the combustion chamber.

According to one design embodiment of the present invention, the holding elements have a fastening portion which points toward the support structure and is configured so as to provide tensile rigidity, and at least two engagement portions which project from the fastening portion and are in particular configured so as to be integral to the latter, wherein each heat shield element has a number of cold-gas proximal recesses, the number of the latter corresponding at least to the number of engagement portions of a holding element, and wherein each engagement portion engages in a form-fitting manner in one of the recesses. A very simple construction is implemented in this way.

The cold-gas proximal recesses of the heat shield element are advantageously configured so as to be elongate, defining in each case one insertion region and, adjoining the latter in the longitudinal direction, one engagement region, wherein the insertion region is configured in such a manner that an assigned engagement portion of a holding element can be inserted radially into said insertion region, the engagement region being conceived for receiving the engagement portion in a form-fitting manner, and the insertion region and the engagement region being configured in such a manner that an engagement portion which is inserted radially into the insertion region can be transferred into the engagement region by being displaced in the longitudinal direction. A construction of this type results in simple assembling.

The fastening portion is advantageously configured in the form of an elongate plate which is in particular curved in the manner of a circular ring segment, wherein the engagement portions are provided in the region of the free ends of the fastening portion.

The engagement portions advantageously project from the fastening portion at an angle which differs from 90°. Alternatively or additionally, the engagement portions can be provided with end regions pointing toward or away from one another.

The fastening portion on the upper side thereof that points toward the heat shield element is advantageously provided with a depression which is conceived for receiving at least one of the spring elements. Accordingly, the at least one spring element can be easily positioned during assembling and subsequently also maintains its position.

According to one design embodiment of the present invention, at least one spring element is in each case guided in such a manner through a passage opening configured on the fastening portion that said at least one spring element in a central region is supported in relation to the support structure. As a result thereof, the advantage of less flexural stress on the fastening portion is obtained. As a consequence of the flexurally stiff mating face of the support structure, the loss in terms of the preloading of the spring elements as a consequence of the creeping deformation of the supporting fastening portion is reduced.

The fastening portions of the holding elements and the spring elements are advantageously provided with correspondingly disposed elongate bores through which tension bolts for pulling the spring elements in the direction of the fastening portions can be inserted. Tension bolts of this type are used for overcoming the spring force of the at least one spring element while the holding element and the at least one spring element are assembled on a heat shield element. The tension bolts are removed again after assembling, so as to generate the desired force-fit between the engagement portions of the holding element and the heat shield element.

According to one design embodiment of the present invention, each heat shield element is held to the support structure by way of two holding elements, in particular by way of exactly two holding elements.

The shaping of the holding elements advantageously takes place while using a casting process or an additive manufacturing method, optionally with subsequent machining. The holding elements according to the invention, as opposed to the holding elements which are described in DE 10 2017 206 502, are thus not bent from a stamped metal sheet. Holding elements of this type, which are bent from a metal sheet also do not have the tensile rigidity in the circumferential direction and in the radial direction, as required according to the invention.

For achieving the object mentioned at the outset, the present invention furthermore achieves an assembly comprising at least one holding element and at least one spring element, wherein the assembly is conceived for implementing a combustion chamber according to the invention. In other words, the at least one holding element as well as the at least one spring element can have those features which have already been described above in the context of the respective component.

The present invention furthermore achieves a heat shield element which is conceived for implementing a combustion chamber according to the invention.

BRIEF DESCRIPTION OF THE DRAWINGS

Further advantages and features of the present invention will become evident by means of the description hereunder of combustion chambers according to embodiments of the present invention with reference to the appended drawing, in which.

DETAILED DESCRIPTION OF INVENTION

Figure 1:
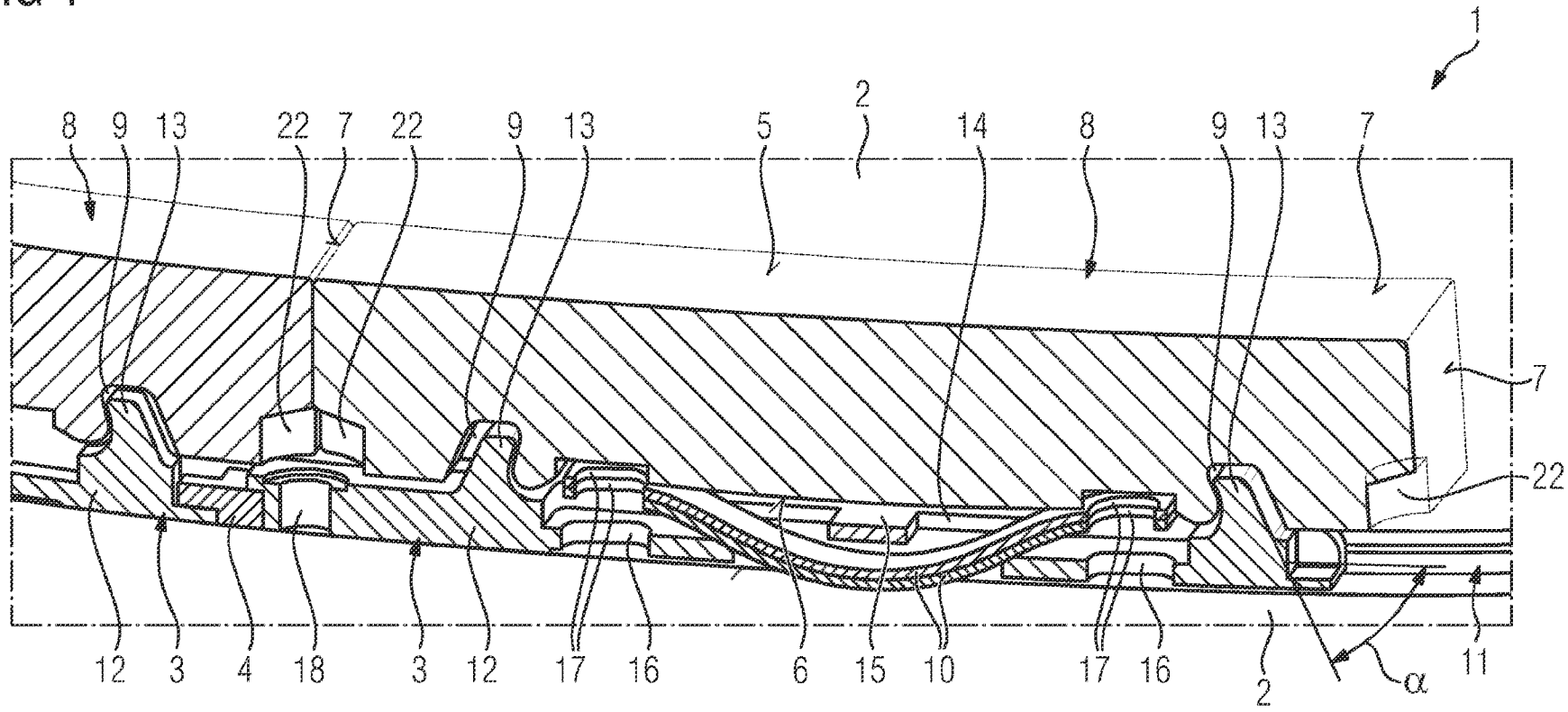
FIG. 1 shows a sectional partial view of a combustion chamber according to an embodiment of the present invention.

The same reference signs hereunder refer to identical components or regions of components, respectively, or to components or regions of components of identical configuration, respectively.

FIGS. 1 to 6 show a combustion chamber 1 according to an embodiment of the present invention, this presently being the combustion chamber of a gas turbine. The combustion chamber 1 comprises a support structure 2; a multiplicity of holding elements 3 fastened to the support structure 2; a multiplicity of connecting elements 4 which connect holding elements 3 which are disposed so as to be adjacent to one another in the circumferential direction U; a multiplicity of heat shield elements 8 which conjointly form a heat shield, have in each case a hot-gas side 5, a cold-gas side 6, and end sides 7 that connect the hot-gas side 5 and the cold-gas side 6 to one another, wherein the holding elements 3 engage in a form-fitting manner in recesses 9 provided on the heat shield elements 8; and spring elements 10 which extend between the support structure 2 and the heat shield elements 8 and are held on the holding elements 3, said spring elements 10 presently being provided in the form of leaf springs bent in an undulating manner.

The support structure 2 is made of metal and is provided with a multiplicity of receptacle grooves 11 which extend circumferentially and are disposed so as to be mutually parallel and have a cross section provided with undercuts, presently a cross section having groove walls which are configured in the shape of steps, said cross section decreasing from the base of the groove to the opening of the groove. The receptacle grooves 11 serve for receiving the holding elements 3 as well as the connecting elements 4, as is described in detail hereunder. However, only the connecting elements 4 have a cross section which corresponds to the cross section of the receptacle grooves 11 such that said connecting elements 4, upon being inserted into one of the receptacle grooves 11, are correspondingly secured by a form-fit in the radial direction R as well as in the axial direction A. The holding elements 3, upon being inserted into a receptacle groove 11, are however secured by a form-fit only in the axial direction A.

The holding elements 3 are made integrally of metal and have substantially a U-shape which is formed by a fastening portion 12 in the form of an elongate plate which is bent in the manner of a circular ring segment, and by two engagement portions 13 which project from the end regions of the fastening portion 12. The fastening portion 12 serves for fastening the holding element 3 in one of the receptacle grooves 11 of the support structure 2. The width of the fastening portion 12 is to this end adapted to the width of the receptacle grooves 11. The lateral walls of the fastening portion 12 are configured so as to be straight, without protrusions, such that the fastening portion 12 can be inserted radially into one of the receptacle grooves 11. The engagement elements 13 by way of the fastening portion 12 are connected to one another so as to provide tensile rigidity in such a manner that a diverging movement of the engagement portions 13 is effectively counteracted at the temperatures prevalent during the operation of the combustion chamber. Furthermore, the engagement portions 13 per se are configured so as to provide tensile rigidity in such a manner that said engagement portions 13 under the action of the spring forces of the spring elements 10 are dimensionally stable at the temperatures prevalent during the operation of the combustion chamber. These tensile strengths are primarily achieved by suitably dimensioning the webs that define the fastening portion 12 and the engagement portions 13. The engagement portions 13 project from the fastening portion 12 at an angle which differs from 90°, presently being approximately 60°, such that the engagement portions 13 are inclined toward one another. In order to receive presently in each case two spring elements 10, each holding element 3 in the central portion of the fastening portion 12 thereof comprises an elongate passage opening 14 which, proceeding from the upper side of the fastening portion 12 from which the engagement portions 13 project, extends to the opposite lower side. The passage opening in the transverse direction is subdivided in an approximately centrical manner by a separation web 15 which however extends only in the upper region of the passage opening 14. This separation web serves for preventing the spring elements 10, which are inserted into the passage opening 14 as shown in FIG. 1, from inadvertently dropping out. Elongate bores 16 on both sides of the passage opening 14 extend through the fastening portion 12, from the upper side thereof to the lower side thereof, said elongate bores 16 in the inserted state of the spring elements 10 being aligned with elongate bores 17 which are configured in the region of the free ends of the spring elements 10. These elongate bores 16 and 17 serve for introducing a tension bolt during assembling, as will yet be explained in more detail hereunder with reference to FIG. 5. The free ends of the fastening portion are in each case conceived for receiving one connecting element 4. The left free end of the fastening portion 12, completely illustrated in FIG. 1, here is designed in such a manner that said free end in the circumferential direction U, and while forming a form-fit, can be pushed into a first end side of a connecting element 4 and be screwed to the support structure 2 in such a manner that the holding element 3 as well as the corresponding connecting element 4 are secured against moving in the circumferential direction U and the holding element is fixed in the radial direction R, to which end a corresponding screw bore 18 is provided. The right free end of the fastening portion 12, completely illustrated in FIG. 1, is designed in such a manner that a second end side of a connecting element 4, in the circumferential direction U can be pushed into said free end while forming a form-fit that radially fixes the holding element 3. The shaping of the holding element 3 presently takes place while using a casting process followed by machining. In principle however, the casting process can also be replaced by an additive manufacturing method.

The heat shield elements 8 presently are configured as CHS heat shield elements and have a completely closed hot-gas side 5. The recesses 9 into which the engagement portions 13 of the holding elements 3 engage are provided on the cold-gas side 6 of the heat shield elements 8. Each heat shield element 8 presently comprises two elongate recesses 9 which extend so as to be mutually parallel and are disposed at a mutual spacing, the latter corresponding to the spacing between the engagement portions 13 of a holding element 3. Each recess 9 defines an insertion region 19 and, adjoining the latter in the longitudinal direction, an engagement region 20. The insertion region 19 is configured in such a manner that an assigned engagement portion 13 of a holding element 3 can be inserted radially into said insertion region 19. The engagement region 12 is however conceived for receiving in a form-fitting manner the corresponding engagement portion 13, wherein the insertion region 19 and the engagement region 20 are configured in such a manner that an engagement portion 13 inserted radially into the insertion region 19 can be transferred into the engagement region 20 by being displaced in the longitudinal direction, see to this end in particular FIG. 3. Four concavities 21 are provided on the cold-gas side 6 for receiving tension bolts which are used when assembling, the positions of said four concavities 21 being adapted to the positions of the free ends of the spring elements 10 in the assembled state. Four recesses 22 which enable the fastening screws inserted into the screw bores 18 to be driven in and out are configured in the transition region between the end sides 7 and the cold side 6 at those positions that in the assembled state cover the screw bores 18 of the holding elements 3.

Figure 2:
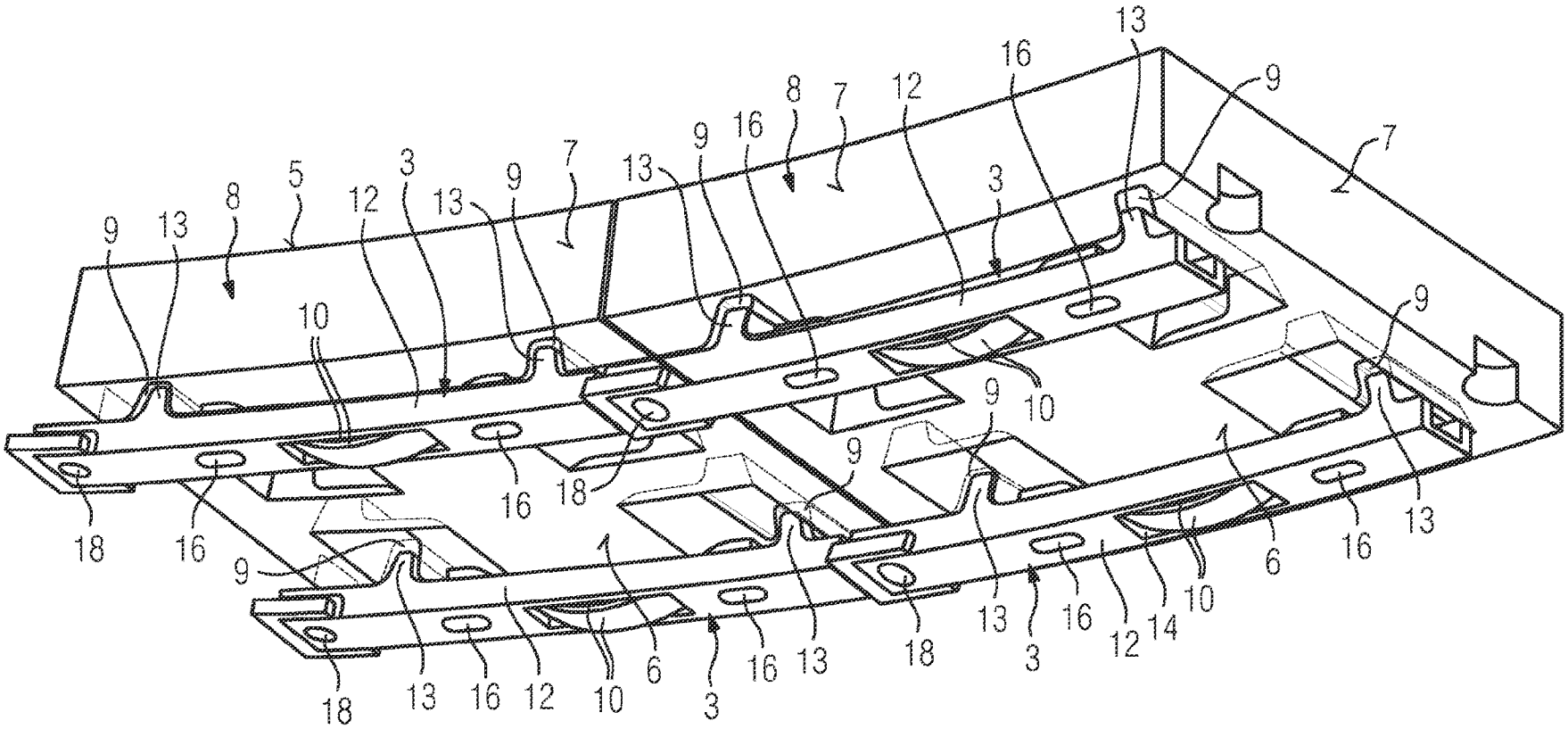
FIG. 2 shows a perspective view, partially illustrated so as to be transparent, from below of the assembly shown in FIG. 1.
Figure 3:
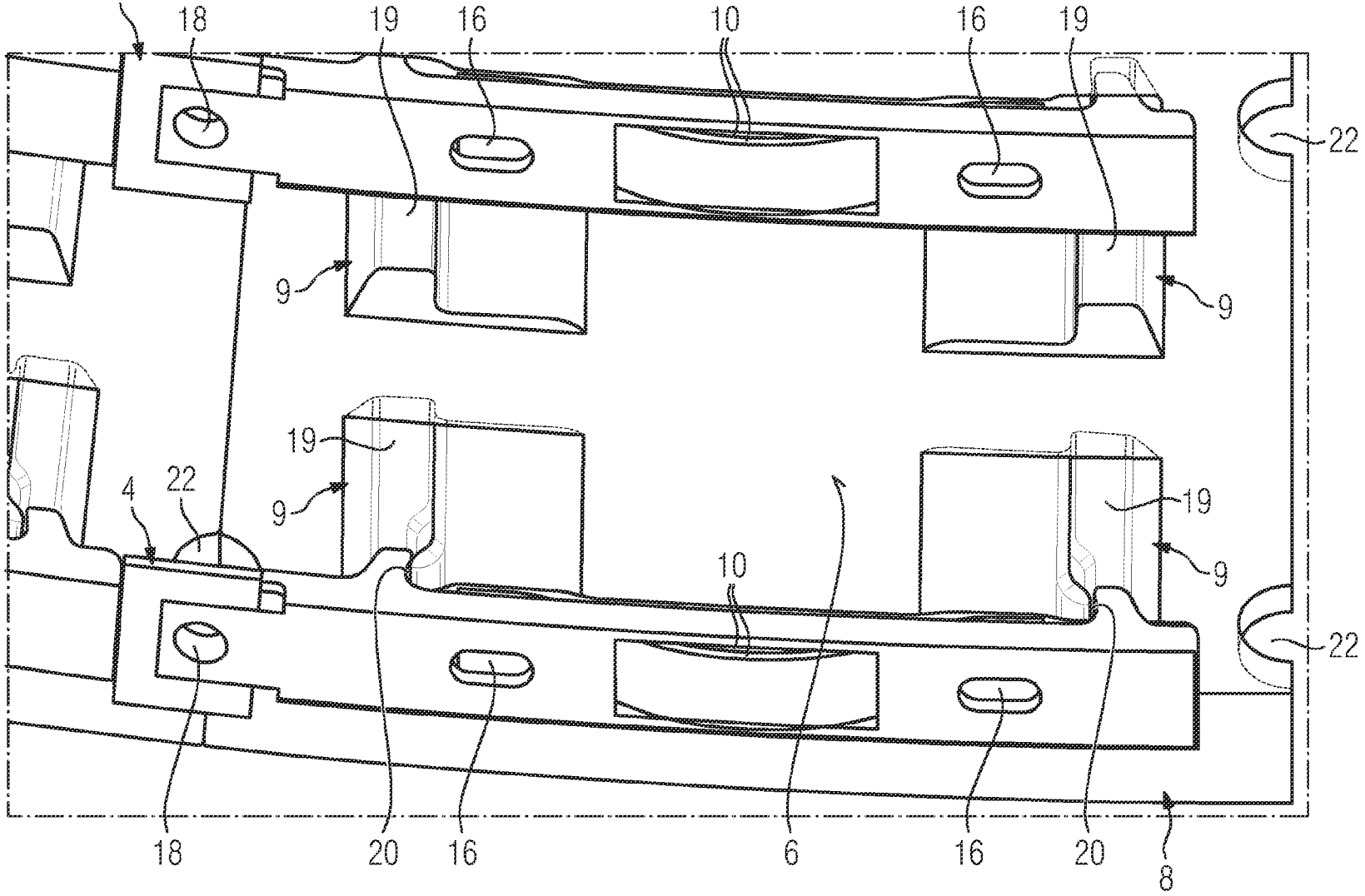
FIG. 3 shows a further perspective view, partially illustrated so as to be transparent, from below of the assembly shown in FIG. 1.
Figure 4:
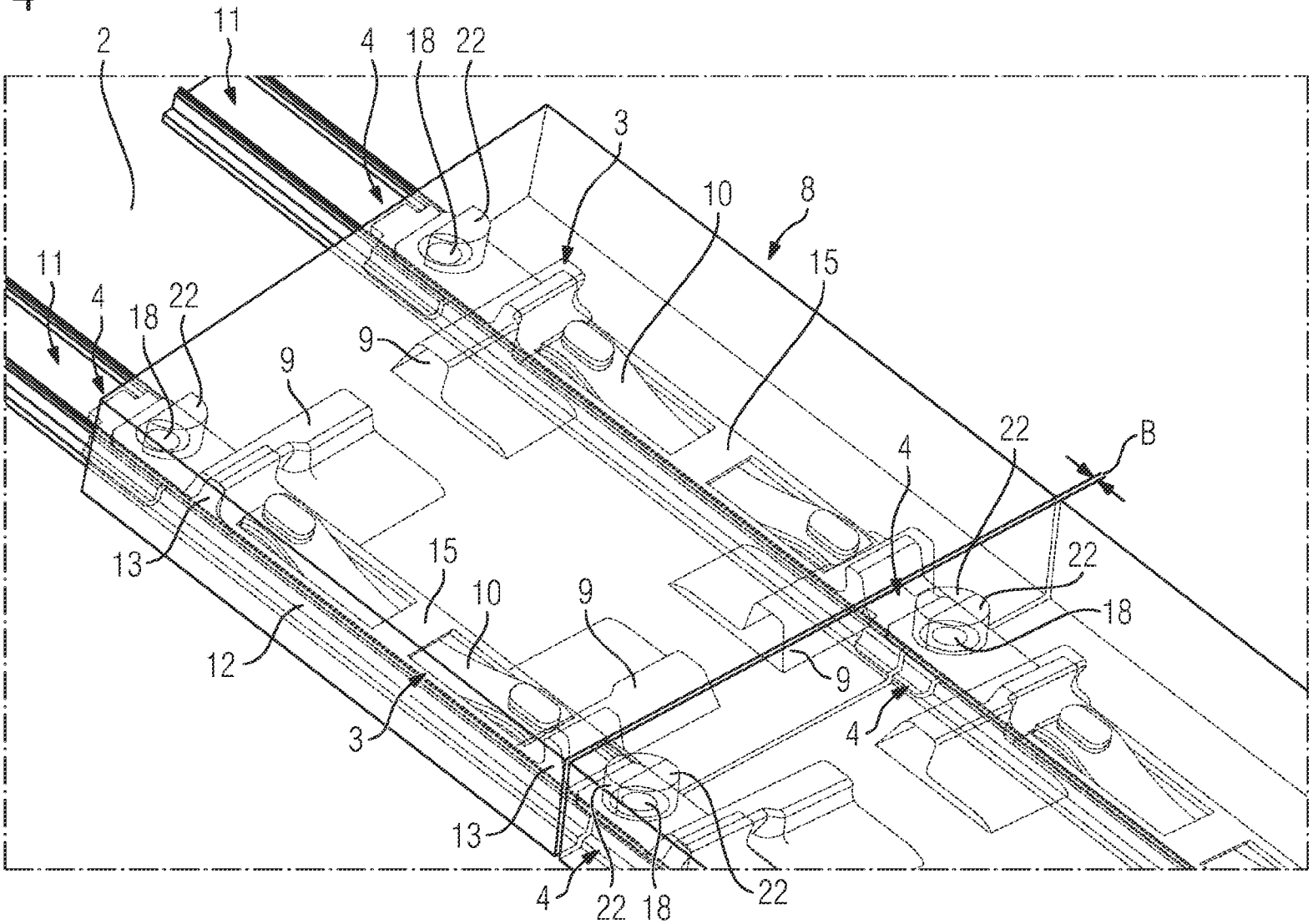
FIG. 4 shows a perspective view, partially illustrated so as to be transparent, from above of the assembly shown in FIG. 1.
Figure 5:
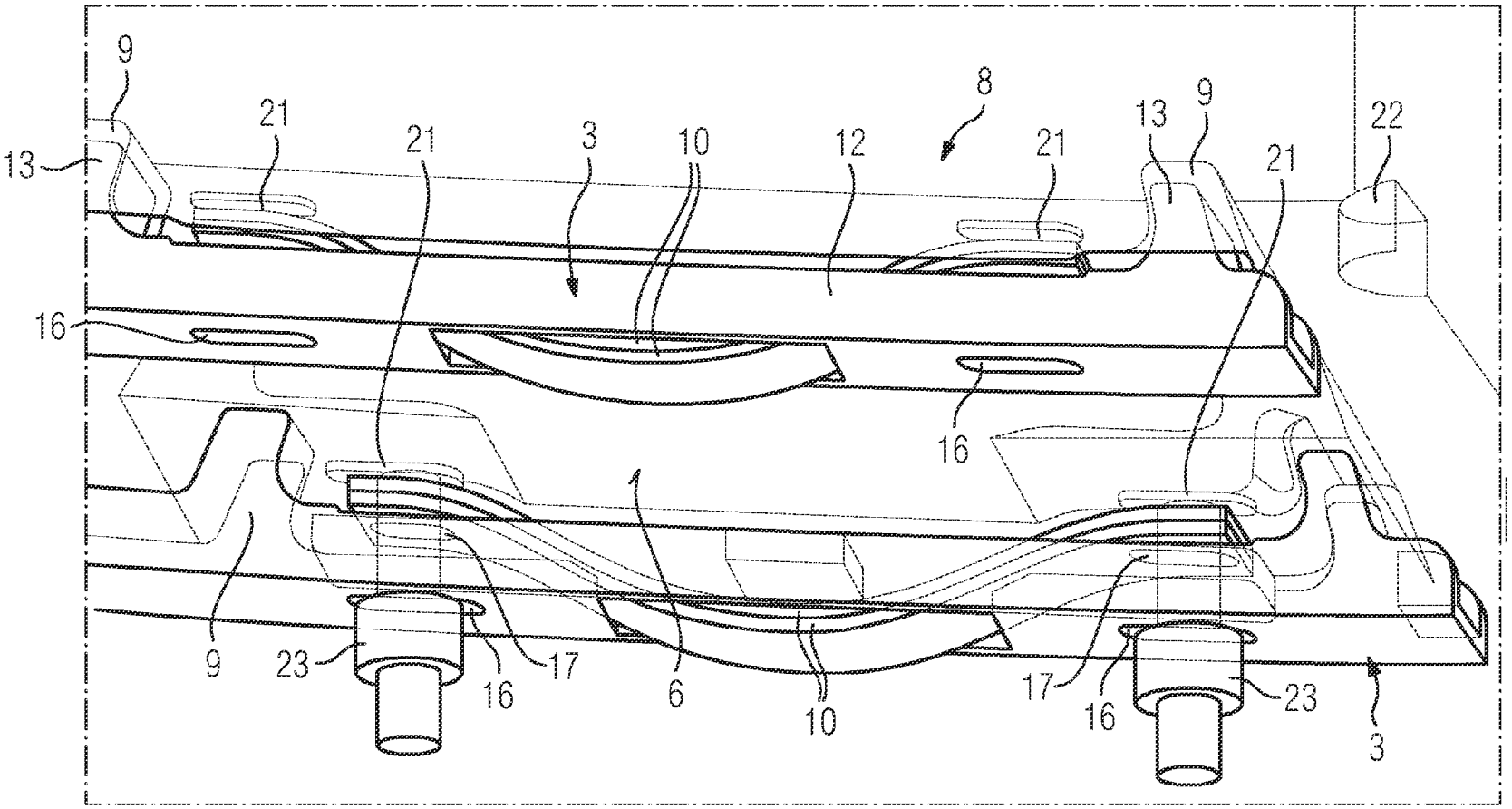
FIG. 5 shows a perspective partial view from below of the assembly illustrated in FIG. 1 during assembling.
Figure 6:
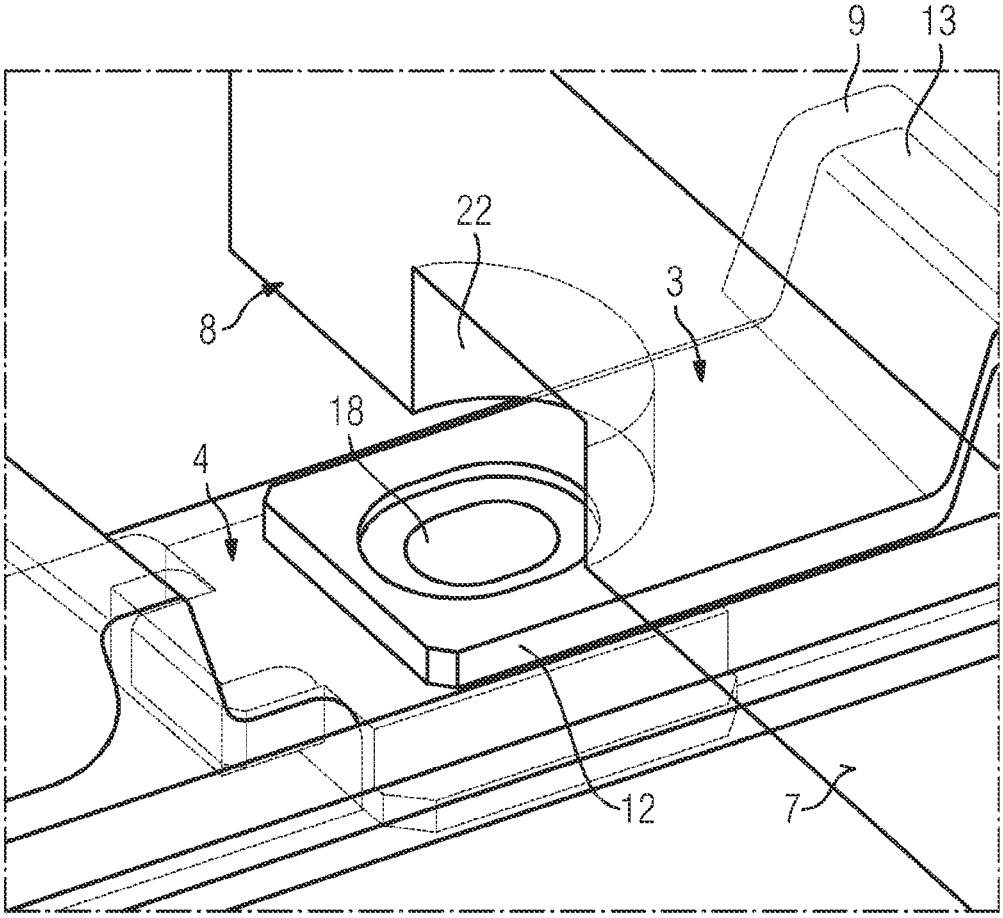
FIG. 6 shows an enlarged prospective partial view of the assembly illustrated in FIG. 1 during assembling.

Two holding elements 3 and four spring elements 10 are required in order for one heat shield element 8 to be assembled. In a first step, two spring elements 10 are in each case inserted into the passage opening 14 of a holding element 4. In a second step, tension bolts 23 are inserted through the elongate bores 16 of the fastening portion 12 and the elongate bores 17 of the spring elements 10, and the free ends of the spring elements 10, while using the tension bolts 23, are pulled in the direction of the fastening portion 12, as is shown in FIG. 5. Subsequently, the engagement portions of the thus prepared holding elements 3 are inserted into the insertion regions 19 of the associated recesses 9 of the heat shield elements 8, and thereafter pushed in the longitudinal direction into the insertion regions 19 such that the insertion portions 13 of the holding elements 3 are held in a form-fitting manner in the engagement regions 20 of the recesses 9. The tension bolts 23 are now released again, whereupon the free ends of the spring elements 10 press against the cold-gas side of the heat shield element 8. In this way, a force-fit between the holding elements 3 and the heat shield element 8 is achieved in addition to the form-fit. In a further step, two connecting elements 4 are in each case pushed into adjacent receptacle grooves 11 and in each case positioned so as to be mutually spaced apart in the circumferential direction U and approximately mutually parallel in the axial direction A. The fastening portions 12 of the holding elements 3 are now inserted radially into the receptacle grooves 11, so as to be between the two connecting elements 4 which are in each case disposed in one receptacle groove 11. Thereafter, the fastening portions 12 of the holding elements 3 are brought to engage with the respective connecting elements 4 by moving the corresponding components in the circumferential direction U, whereby screw bores 18 of the holding elements 3 are positioned so as to be aligned with threaded bores, not illustrated in more detail, which are provided in the support structure 2. Fastening screws are subsequently inserted into the screw bores 18 of the holding elements 3 and screwed into the threaded bores. The assembling of the next heat shield element 3 can now take place, as is shown in FIGS. 1, 2 and 4.

The assembly described above is distinguished in particular in that the gap width B between heat shield elements 8 disposed adjacent to one another can be chosen to be very minor. The reason therefor lies primarily in the holding elements 3 which are configured so as to provide tensile rigidity, on the one hand, and in the fact that the heating shield elements 8 are positioned at a comparatively large spacing from the support structure 2, which is why the heat shield elements 8 can readily expand in the radial direction R during the operation of the combustion chamber, on the other hand. Thanks to the minor gap width B, only a minor volumetric flow of sealing air is required, this being associated with a significantly increased efficiency of the gas turbine. Moreover, by virtue of the fact that the recesses 9 are provided on the cold-gas side 6 of the heat shield elements 8, the holding elements 3 are completely covered by the heat shield elements 8 and correspondingly better thermally protected, such that the cooling requirement of the holding elements 3 is also less. The same applies to the required maintenance because the holding elements 3 are subjected to less wear.

Figure 7:
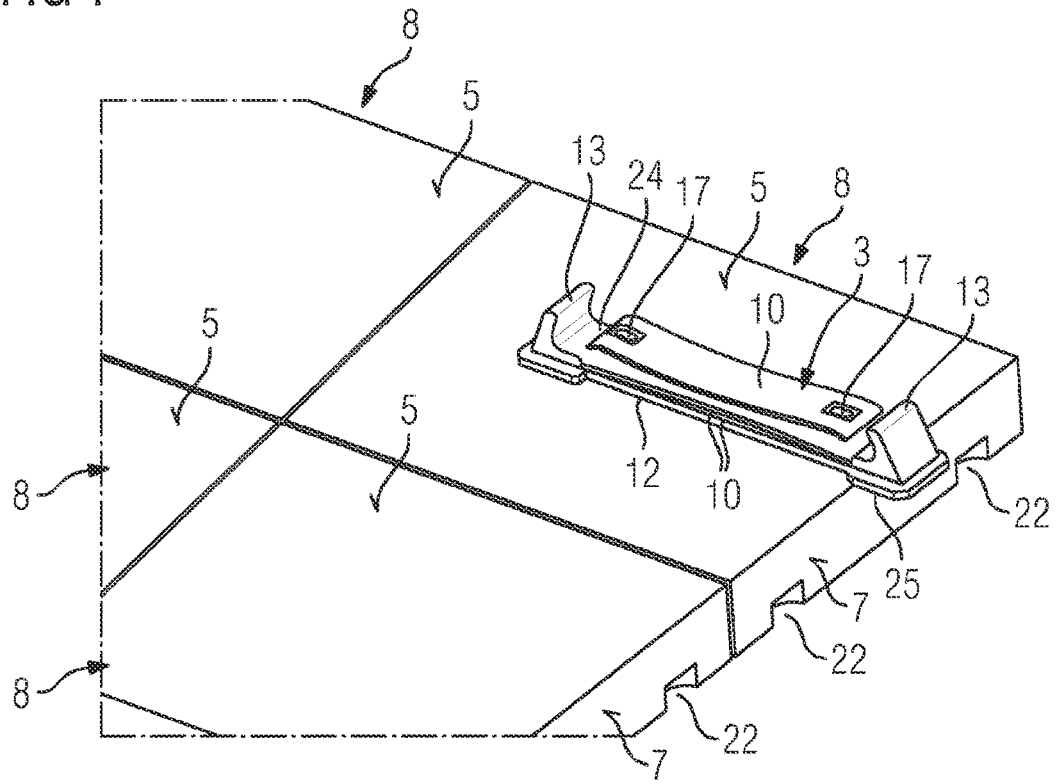
FIG. 7 shows a perspective partial view, partially illustrated so as to be transparent, of a combustion chamber according to a further embodiment of the present invention.
Figure 8:
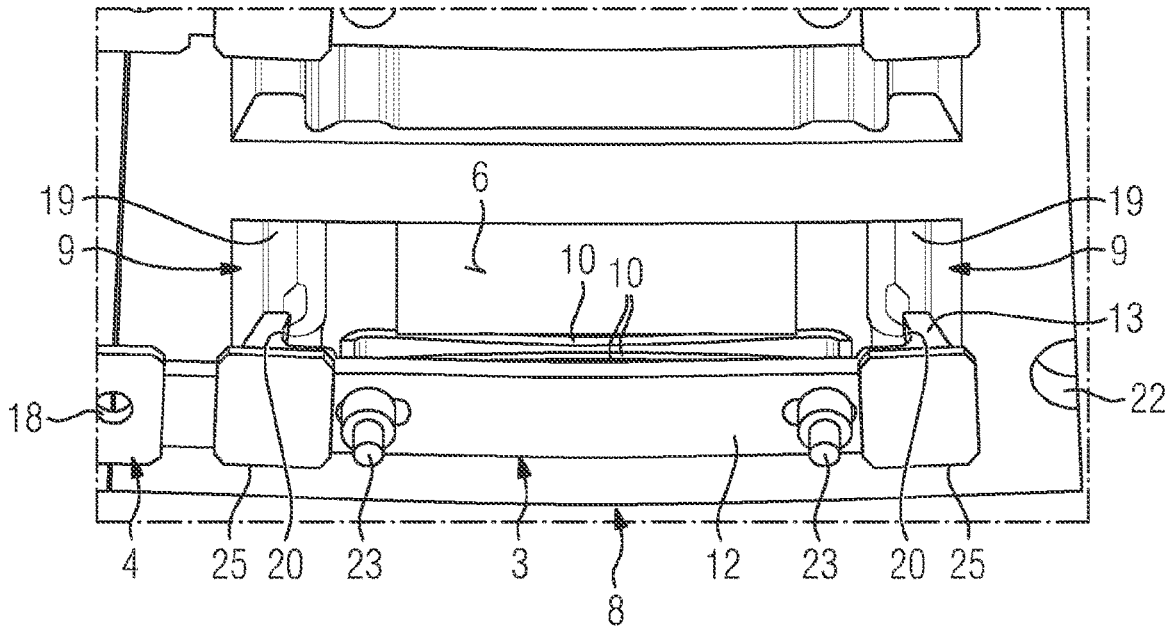
FIG. 8 shows a perspective view from below of the assembly shown in FIG. 7.

FIGS. 7 and 8 show a combustion chamber 1 according to a further embodiment of the present invention, the latter differing from the previously described embodiment only in terms of a few details relating to the configuration of the holding elements 3, the connecting elements 4 and the spring elements 10, which is why only these details will be discussed hereunder and reference otherwise is made to the preceding embodiments. The holding elements 3, like before, have in each case one fastening portion 12 and two engagement portions 13. However, the fastening portion is not provided with a passage opening 14, but at the upper side of said fastening portion is provided with a depression 24 for receiving the lower two of a total of three spring elements 10. The fastening portion 12 in the opposite end regions thereof furthermore comprises outwardly projecting protrusions 25, the contour of the latter being chosen so as to correspond to the cross section of the receptacle grooves 11 such that said protrusions 25 engage in a form-fitting manner in the receptacle grooves 11. This leads to the fastening portions 12 of the holding elements 3, like the connecting elements 4, also being able to be pushed into the receptacle grooves 11 in the circumferential direction and no longer being able to be inserted radially into said receptacle grooves 11, as described above. Moreover, the connecting elements 4, not the fastening portions 12 of the holding elements 3, are provided with a screw bore 18 such that the fixing of the holding elements 3 and of the connecting elements 4 in the circumferential direction U now takes place by way of screwing the connecting elements 4 to the support structure 2. As has already been mentioned above, three spring elements 10 are provided instead of two spring elements 10, wherein the alignment of the lower two spring elements 10 is chosen so as to be counter to the alignment described above, thus with the crest of the undulation directed upward.

While the invention has been illustrated and described in detail by way of the exemplary embodiment, the invention is not limited by the disclosed examples and other variations here can be derived by the person skilled in the art without departing from the scope of protection of the invention.

The invention claimed is:

1. A combustion chamber, comprising:

a support structure, a multiplicity of holding elements which are fastened to the support structure, and a multiplicity of heat shield elements which conjointly form a heat shield, comprising in each case a hot-gas side, a cold-gas side and end sides that connect the hot-gas side and the cold-gas side to one another, wherein the holding elements engage in a form-fitting manner in recesses which are provided on the heat shield elements, wherein the holding elements comprise in each case at least two engagement portions configured for engaging in the form-fitting manner in the recesses of the heat shield elements, said at least two engagement portions being connected to one another so as to provide tensile rigidity in such a manner that a diverging movement of the at least two engagement portions is effectively counteracted at the temperatures prevalent during the operation of the combustion chamber, wherein spring elements exert radial spring forces on the cold gas side which urge the heat shield elements away from the holding elements and away from the support structure and which thereby causes a force-fit between the at least two engagement portions of the holding elements and the heat shield elements, and wherein the spring elements extend between the support structure and the heat shield elements, wherein the at least two engagement portions are configured to convert the radial spring forces into a circumferential clamping force on the heat shield elements, wherein the holding elements comprise a fastening portion which points toward the support structure and is configured so as to provide the tensile rigidity, and comprise the at least two engagement portions which project from the fastening portion, wherein each of the heat shield elements comprises a number of the recesses, the number of the latter corresponding at least to a number of the at least two engagement portions of one of the holding elements, wherein each of the at least two engagement portions engages in the form-fitting manner in one of the recesses, and wherein at least one of the spring elements is in each case guided in such a manner through a passage opening configured on the fastening portion that said at least one spring element in a central region contacts and is thereby directly supported by the support structure.

2. The combustion chamber as claimed in claim 1, wherein the recesses comprise blind recesses that are recessed into the cold-gas side of the heat shield elements.

3. The combustion chamber as claimed in claim 1, wherein the support structure is provided with circumferentially extending receptacle grooves for receiving the holding elements.

4. The combustion chamber as claimed in claim 1, wherein the holding elements which are disposed so as to be circumferentially adjacent to one another are releasably connected to one another by way of connecting elements.

5. The combustion chamber as claimed in claim 4, wherein the support structure is provided with circumferentially extending receptacle grooves for receiving the holding elements, and wherein the receptacle grooves comprise a cross-section provided with undercuts, and the holding elements and/or the connecting elements are received in a form-fitting manner in the receptacle grooves.

6. The combustion chamber as claimed in claim 1, wherein the recesses of the heat shield elements are configured so as to be elongate, defining in each case one insertion region and, adjoining the latter in a longitudinal direction, one engagement region, wherein the insertion region is configured in such a manner that an assigned engagement portion of the holding element can be inserted radially into said insertion region, wherein the engagement region is configured for receiving the assigned engagement portion in the form-fitting manner, and wherein the insertion region and the engagement region are configured in such a manner that an engagement portion which is inserted radially into the insertion region can be transferred into the engagement region by being displaced in the longitudinal direction.

7. The combustion chamber as claimed claim 1, wherein the fastening portion is configured in the form of an elongate plate, and wherein the at least two engagement portions are provided in a region of free ends of the fastening portion.

8. The combustion chamber as claimed in claim 1, wherein the at least two engagement portions project from the fastening portion at an angle which differs from 90°, and/or wherein the at least two engagement portions are provided with end regions pointing toward or away from one another.

9. The combustion chamber as claimed claim 1, wherein the fastening portion on the upper side thereof that points toward the heat shield elements is provided with a depression which is configured for receiving at least one of the spring elements.

10. The combustion chamber as claimed in claim 1, wherein the fastening portions of the holding elements and the spring elements are provided with correspondingly disposed elongate bores through which tension bolts for pulling the spring elements in the direction of the fastening portions can be inserted.

11. The combustion chamber as claimed in claim 1, wherein each of the heat shield elements is held to the support structure by way of two of the holding elements.

12. The combustion chamber as claimed in claim 1, wherein the shaping of the holding elements takes place while using a casting process or an additive manufacturing method, optionally with subsequent machining.

13. An assembly, comprising:

at least one holding element and at least one spring element, wherein said assembly is configured for implementing a combustion chamber as claimed in claim 1.

14. A heat shield element, configured for implementing a combustion chamber as claimed in claim 1.

15. The combustion chamber as claimed in claim 1, wherein the combustion chamber comprises a combustion chamber of a gas turbine.

16. The combustion chamber as claimed in claim 1, wherein the spring elements are configured as leaf springs.

17. The combustion chamber as claimed in claim 1, wherein the at least two engagement portions are configured so as to be integral to the fastening portion.

18. The combustion chamber as claimed in claim 1, wherein two engagement portions of the at least two engagement portions comprise engagement portion contact surfaces that face each other and that taper toward each other in a radial direction, wherein two recesses of the recesses receive the engagement portion contact surfaces and comprise recess contact surfaces that contact the engagement portion contact surfaces and that taper toward each other in the radial direction;

wherein the radial spring forces urge the heat shield elements in the radial direction and wedge the recess contact surfaces between the engagement portion contact surfaces to generate the force fit.

19. A combustion chamber, comprising:

a support structure, a multiplicity of holding elements which are fastened to the support structure, and a multiplicity of heat shield elements which conjointly form a heat shield, comprising in each case a hot-gas side, a cold-gas side and end sides that connect the hot-gas side and the cold-gas side to one another, wherein the holding elements engage in a form-fitting manner in recesses which are provided on the heat shield elements, wherein the holding elements comprise in each case at least two engagement portions configured for engaging in the form-fitting manner in the recesses of the heat shield elements, said at least two engagement portions being connected to one another so as to provide tensile rigidity in such a manner that a diverging movement of the at least two engagement portions is effectively counteracted at the temperatures prevalent during the operation of the combustion chamber, wherein spring elements exert radial spring forces which causes a force-fit between the at least two engagement portions of the holding elements and the heat shield elements, and wherein the spring elements extend between the support structure and the heat shield elements, wherein the at least two engagement portions are configured to convert the radial spring forces into a circumferential clamping force on the heat shield elements, wherein the holding elements comprise a fastening portion which points toward the support structure and is configured so as to provide the tensile rigidity, and comprise the at least two engagement portions which project from the fastening portion, wherein each of the heat shield elements comprises a number of the recesses, the number of the latter corresponding at least to a number of the at least two engagement portions of one of the holding elements, wherein each of the at least two engagement portions engages in the form-fitting manner in one of the recesses, and wherein at least one of the spring elements is in each case guided in such a manner through a passage opening configured on the fastening portion that said at least one spring element in a central region contacts and is thereby directly supported by the support structure.

* * * * *